US008929767B2

(12) United States Patent
Liu et al.

(10) Patent No.: US 8,929,767 B2
(45) Date of Patent: Jan. 6, 2015

(54) DUAL ROLL SYSTEM INTEGRATING A DELIVERY ROLL AND A CLEANING ROLL TO EXTEND THE LIFETIME OF THE BCR SYSTEM

(71) Applicant: Xerox Corporation, Norwalk, CT (US)

(72) Inventors: Yu Liu, Mississauga (CA); Sarah J. Vella, Windsor (CA); Gregory McGuire, Oakville (CA); Gaetano Lavigne, Burlington (CA); Nan-xing Hu, Oakville (CA); Johann Junginger, Toronto (CA)

(73) Assignee: Xerox Corporation, Norwalk, CT (US)

( * ) Notice: Subject to any disclaimer, the term of this patent is extended or adjusted under 35 U.S.C. 154(b) by 21 days.

(21) Appl. No.: 13/773,430

(22) Filed: Feb. 21, 2013

(65) Prior Publication Data

US 2014/0233980 A1 Aug. 21, 2014

(51) Int. Cl.
*G03G 15/02* (2006.01)
*G03G 21/00* (2006.01)

(52) U.S. Cl.
CPC ..... *G03G 21/0094* (2013.01)
USPC ..... 399/100; 399/176

(58) Field of Classification Search
USPC ..... 399/100, 174, 176, 168, 128
See application file for complete search history.

(56) References Cited

U.S. PATENT DOCUMENTS

| | | | | |
|---|---|---|---|---|
| 4,387,980 | A | 6/1983 | Ueno et al. | |
| 4,435,074 | A | 3/1984 | Midorikawa et al. | |
| 5,215,839 | A | 6/1993 | Yu | |
| 5,660,961 | A | 8/1997 | Yu | |
| 5,958,638 | A | 9/1999 | Katayama et al. | |
| 6,233,419 | B1 * | 5/2001 | Chigono et al. | 399/176 |
| 6,272,301 | B1 * | 8/2001 | Kawada et al. | |
| 6,381,432 | B1 | 4/2002 | Hattori | |
| 7,515,846 | B2 | 4/2009 | Miyaji | |
| 7,580,655 | B2 | 8/2009 | Nukada et al. | |
| 7,725,069 | B2 | 5/2010 | Kawahara et al. | |
| 7,881,651 | B2 | 2/2011 | Watanabe | |
| 8,064,791 | B2 | 11/2011 | Imaizumi | |
| 8,180,256 | B2 | 5/2012 | Komatsu | |
| 8,676,089 | B2 | 3/2014 | Vella et al. | |
| 2004/0019986 | A1 | 2/2004 | Corrado et al. | |
| 2009/0169237 | A1 | 7/2009 | Shouno et al. | |
| 2010/0189461 | A1 | 7/2010 | Shintani et al. | |
| 2011/0123239 | A1 | 5/2011 | Azeyanagi et al. | |
| 2012/0201585 | A1 | 8/2012 | Hu et al. | |
| 2013/0028636 | A1 | 1/2013 | Hu et al. | |
| 2013/0101327 | A1 | 4/2013 | Vella et al. | |
| 2013/0108312 | A1 | 5/2013 | McGuire et al. | |
| 2013/0156474 | A1 | 6/2013 | McGuire et al. | |

* cited by examiner

*Primary Examiner* — Sophia S Chen
(74) *Attorney, Agent, or Firm* — Pillsbury Winthrop Shaw Pittman LLP

(57) ABSTRACT

An image forming apparatus including an electrophotographic photoconductive member, a charging unit, a delivery unit and a cleaning unit. The charging unit is disposed in contact with the surface of the photoconductive member and the delivery unit disposed in contact with the surface of the charging unit. The delivery unit applies a layer of functional material to a surface of the charging unit and the charging unit in turn applies a layer of the functional material onto the surface of the photoconductive member. The cleaning unit is disposed in contact with a surface of the charging unit to clean the charging unit and reduce contamination of a surface of the delivery unit. The cleaning unit is disposed in an upstream direction of the delivery roller relative to a rotation direction of the charging unit.

14 Claims, 5 Drawing Sheets

DUAL ROLL SYSTEM INTEGRATING A DELIVERY ROLL AND A CLEANING ROLL TO EXTEND THE LIFETIME OF THE BCR SYSTEM

BACKGROUND

The present disclosure is generally directed to establish a dual-roll system which integrates both a delivery member and a cleaning foam member in direct contact with a bias-charge roll (BCR) surface. The present invention increases the effective lifetime of the BCR cleaning system and the delivery member (or liquid materials applicator system). The delivery member may be a delivery roller and the cleaning foam member may be a cleaning foam roller.

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image may be developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original image or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images. To charge the surface of a photoreceptor, a contact type charging device has been used, such as disclosed in U.S. Pat. Nos. 4,387,980 and 7,580,655, which are incorporated herein by reference. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The outer surface of the image bearing member is charged at the contact area. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

To further increase the service life of the photoreceptor, use of overcoat layers has also been implemented to protect photoreceptors and improve performance, such as wear resistance. However, these low wear overcoats are associated with poor image quality due to A-zone deletion (i.e. an image defect occurred in A-zone: 28° C., 85% RH) in a humid environment as the wear rates decrease to a certain level. For example, most organic photoconductor (OPC) materials sets require a certain level of wear rate in order to suppress A-zone deletion, thus limiting the life of a photoreceptor. In addition, high torque associated with low wear overcoats in A-zone also causes severe issues, such as motor failure and cleaning blade damage.

However, even such conventional photoreceptors are not necessarily sufficient in electrophotographic characteristics and durability, particularly when they are used in combination with a charger of the contact-charging system (contact charger) or a cleaning apparatus, such as a cleaning blade. Further, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a transfer step. Still further, the use of a cleaning blade to remove discharge product or remaining toner from the surface of the photoreceptor involves friction and abrasion between the surface of the photoreceptor and the cleaning blade, which tends to damage the surface of the photoreceptor, breaks the cleaning blade or turns up the cleaning blade. As a result of this repetitive cycling, the outermost layer of the photoreceptor experiences a high degree of frictional contact with other machine subsystem components used to clean and/or prepare the photoreceptor for imaging during each cycle. When repeatedly subjected to cyclic mechanical interactions against the machine subsystem components, photoreceptor belts can experience severe frictional wear at the outermost organic photoreceptor layer surface that can greatly reduce the useful life of the photoreceptor. Ultimately, the resulting wear impairs photoreceptor performance and thus image quality. Below are a number of prior art patents and/or publications that discuss the above concepts.

U.S. Patent Publication No. 20090169237 to Shouno et al. discloses a cleaning roller for cleaning a charging roller in an image forming apparatus. The cleaning roller is in contact with an outer peripheral surface of the charging roller to remove foreign materials attached to the outer peripheral surface.

U.S. Pat. No. 6,381,432 to Hattori discloses a power supply roller, which rotates while contacting the surface of the charging roller, and applies a bias to the charging roller for charging a surface of the photoconductive drum uniformly. Brushes may be provided on the surface of the power supply roller. A member may also be supplied for removing toner and sheet particles adhering to the surface of the charging roller and the power supply roller.

U.S. Patent Publication No. 2004019986 discloses a contact cleaning roller which may be axially flexed to conform to a non-planar substrate for removing particles therefrom. A flexible shaft is covered with a high-tack sleeve comprising polyurethane, silicone, adhesive tape, or any other similar high-tack material. The shaft is rotatably suspended at either end in bearings in a frame, allowing the roller to conform to a non-planar substrate surface requiring cleaning.

U.S. Pat. No. 7,515,846 to Miyagi disclose a cleaning device that cleans a charging roller, which charges the outer circumferential surface of a photoconductive drum. The cleaning device has a rotary shaft that rotates in contact with the outer circumferential surface of the charging roller and cleans the outer circumferential surface of the charging roller by brushing. The rotational driving unit rotates the cleaning member. A thrust driving unit reciprocates the cleaning member along the rotary axis of the charging roller while holding the cleaning member in sliding contact with the outer circumferential surface of the charging roller.

U.S. Pat. No. 8,064,791 to Imaizumi discloses a charging device which has a rotatable charging member that electrically charges a photosensitive member. A brush, which rotates along a rotational direction of the charging member by contacting the charging member to receive a force, includes fiber for cleaning the charging member. The fibers have been subjected to a fiber-tilting treatment so that the fibers are tilted in a direction counterdirectionally with a rotation direction of the brush.

U.S. Pat. No. 8,180,256 to Komatsu discloses an image forming apparatus including a photosensitive member, a developing device, a transferring device, a first brush and a second brush. The first brush is downstream of the transfer position and upstream of the photosensitive member charging position. The second brush is downstream of the toner charging position and upstream of the photosensitive member charging position. The first brush is supplied with a charging bias having a polarity opposite to a regular charge polarity of the toner. The second brush is supplied with a charging bias having a same polarity as the regular charge polarity.

U.S. Pat. Nos. 4,435,074, 7,881,651, and US 20100189461 describe a method to use lubricant application brush to apply fine solid powder to PIR surface to lubricate cleaning blade. US 20100189461, US 20110123239, U.S. Pat. No. 7,725,069 describe strategies to extend lifetime of brush applicator.

An improved electrophotographic imaging member has been developed that comprises a very thin outer layer on the imaging member surface that comprises functional materials that act as a lubricant and or a barrier against moisture and/or surface contaminants. The outer layer imparts improved xerographic performance to imaging members incorporating such an outer layer, such as improved wear resistance, low friction, and reduced image defects due to deletion in high humidity conditions. A surface control method has been developed that involves the continuous delivery of a liquid functional material, such as paraffin oil, to the surface of an electrophotographic imaging member through an oil-impregnated delivery roll in direct contact with the BCR (Ser. No. 13/192,215). An improved electrophotographic imaging member comprises a very thin outer layer on the imaging member surface that includes functional materials that act as a lubricant and or a barrier against moisture and/or surface contaminants. The outer layer imparts improved xerographic performance to imaging members incorporating such an outer layer, such as improved wear resistance, low friction, and reduced image defects due to deletion in high humidity conditions.

Illustratively, US Patent Publication No. 20120201585, and U.S. patent application Ser. Nos. 13/192,215, 13/192,252, and 13/279,981, 13/286,905, 13/326,414 describe this improved method of applying, via a delivery roller, an ultra-thin layer of functional materials such as paraffin oil through self-diffusion on ultra-low PIR surface to suppress A-zone deletion and high-torque.

In these embodiments, the delivery roll delivers the functional materials to the outer layer of an imaging surface. As used herein, "functional material" is a material that provides maintenance of desired photoreceptor function. For example, the functional material may be one that is continuously applied onto the photoreceptor surface through direct contact transfer and which can maintain the desired function(s) of the photoreceptor by providing continued lubrication and surface protection. Lubrication of the photoreceptor surface improves interaction with other components in a xerographic system, such as for example, the blade cleaner to reduce torque and blade damage. By maintaining a thin layer of surface material on the photoreceptor, the functional material also provides surface protection to prevent image deletion in, for example, a humid environment such as A-zone.

The paraffin oil as applied over the photoreceptor surface alleviates the chattering of blade and reduces toner contamination on the BCR. However, in practice relying only on this improvement in the delivery roll does not completely address the contamination issue, i.e., there is additive accumulation on BCR during longer-time cycling. Furthermore, additives also start to build up on the delivery roll surface to block effective diffusion of oil from the roll body, which shortens the lifetime of the delivery roll.

Accordingly, a need exists for a new apparatus that extends the lifetimes of the BCR, the photoreceptor, the cleaning mechanism and the delivery roller.

SUMMARY OF THE INVENTION

In embodiments of the invention, an image forming apparatus is disclosed comprising an electrophotographic photoconductive member, a charging unit, a delivery unit and a cleaning unit. The charging unit is disposed in contact with the surface of the photoconductive member and the delivery unit disposed in contact with the surface of the charging unit. The delivery unit applies a layer of functional material to a surface of the charging unit and the charging unit in turn applies a layer of the functional material onto the surface of the photoconductive member. The cleaning unit is disposed in contact with a surface of the charging unit to clean the charging unit and reduce contamination of a surface of the delivery unit. The cleaning unit is disposed in an upstream direction of the delivery roller relative to a rotation direction of the charging unit.

In embodiments of the invention, an image forming apparatus comprises an electrophotographic photoconductive member, a charging unit, a delivery unit, a first cleaning unit, an electrostatic latent image forming unit, a toner developing unit, a transfer unit and a second cleaning unit. The charging unit is disposed in contact with the surface of the photoconductive member and the delivery unit is disposed in contact with the surface of the charging roller. The delivery unit applies a layer of functional material to the surface of the charging roller that in turn applies a layer of functional material to the surface of the photoconductive member. The first cleaning unit is disposed in contact with a surface of the charging roller to clean the charging unit and reduce contamination of a surface the delivery unit. The electrostatic latent image forming unit develops an electrostatic latent image on the photoconductive member and the toner developing unit applies toner to the photoconductive member to develop a toner image on the photoconductive member. The transfer unit transfers the developed toner image from the photoconductive member to a copy substrate or an intermediate member and the second cleaning unit for cleaning the photoconductive member to remove toner particles.

DETAILED DESCRIPTION

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The disclosed embodiments are directed generally to a dual-roll system that integrates both a delivery unit and a cleaning unit with a charging unit. This replaces prior art systems including only one of either a delivery unit or a cleaning unit. In embodiments, the cleaning foam unit is placed in an upstream direction of the delivery unit, relative to a rotation direction of the charging unit, so that the contamination particles that are transferred onto the charging unit could be more effectively cleaned by the cleaning foam roll before contaminating the delivery unit. This is in contrast to prior art systems having the cleaning unit in a position where it is in contact with a surface of the photoreceptor. In addition, the oil diffused from the delivery unit is effectively delivered to the photoreceptor surface instead of being absorbed by the cleaning foam roller.

Figure 1:
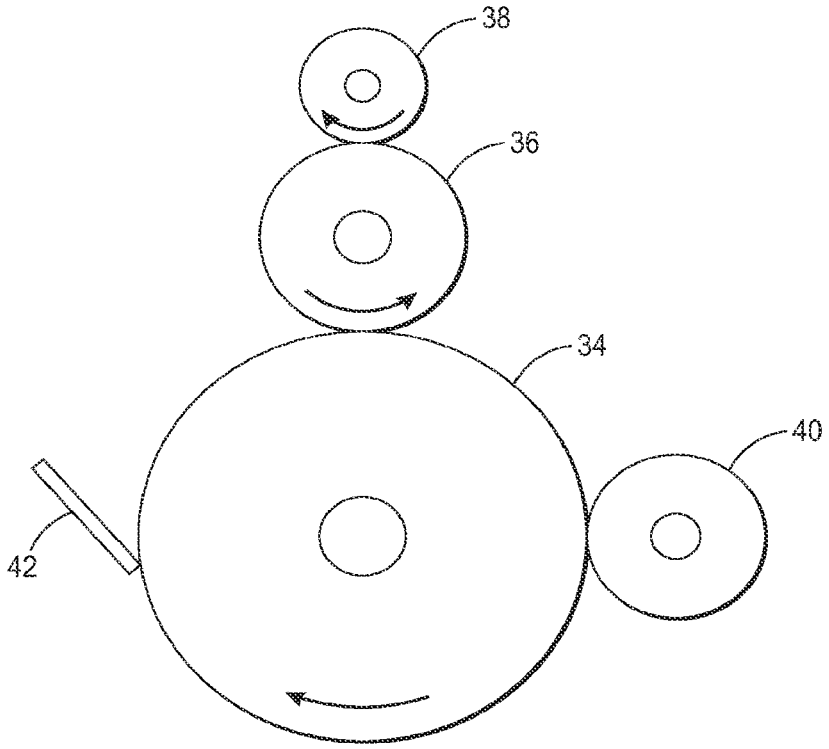
FIG. 1 PRIOR ART
FIG. 1 illustrates an image forming apparatus according to the prior, art system.

FIG. 1 illustrates an image forming apparatus according to the prior art system described in U.S. patent application Ser. No. 13/192,215. The image-forming apparatus includes a photoreceptor 34, a BCR 36 and a delivery member 38. The delivery member 38 contacts the BCR 36 to deliver an ultra-thin layer of the functional material onto the surface of the BCR 36. The BCR 36, in turn, transfers the functional material onto the surface of the photoreceptor 34. The delivery member may be integrated into a xerographic printing system in various configurations and positions. As can be seen, the overcoated photoreceptor drum 34 rotates, the delivery member 38 impregnated with the functional material delivers the functional materials to the surface of the BCR roller 36, which in turn, delivers the functional materials to the surface of the overcoated photoreceptor 34 through contact diffusion. For example, the amount of the functional material delivered onto the surface of the imaging member is controlled by the diffusion rate of the functional material in the elastic material of the delivery member.

Subsequently, the photoreceptor 34 is substantially uniformly charged by the BCR 36 to initiate the electrophotographic reproduction process. The charged photoreceptor 34 is then exposed to a light image to create an electrostatic latent image on the photoreceptive member (not shown). The latent image is subsequently developed into a visible image by a toner developer 40. Thereafter, the developed toner image is transferred from the photoreceptive member to a copy sheet or some other image support substrate to which the image can be permanently affixed for producing a reproduction of the original document (not shown). The photoreceptor surface is generally then cleaned with a cleaner 42 to remove any residual developing material thereform, in preparation for successive imaging cycles. While not necessary, a supplying unit containing the functional materials may be included for supply of the functional material to the delivery member. In embodiments which do not have the supplying unit, the supplying unit may be selected from the group consisting of a reservoir, polymeric matrix, porous foam, membrane and fabrics.

Figure 2:
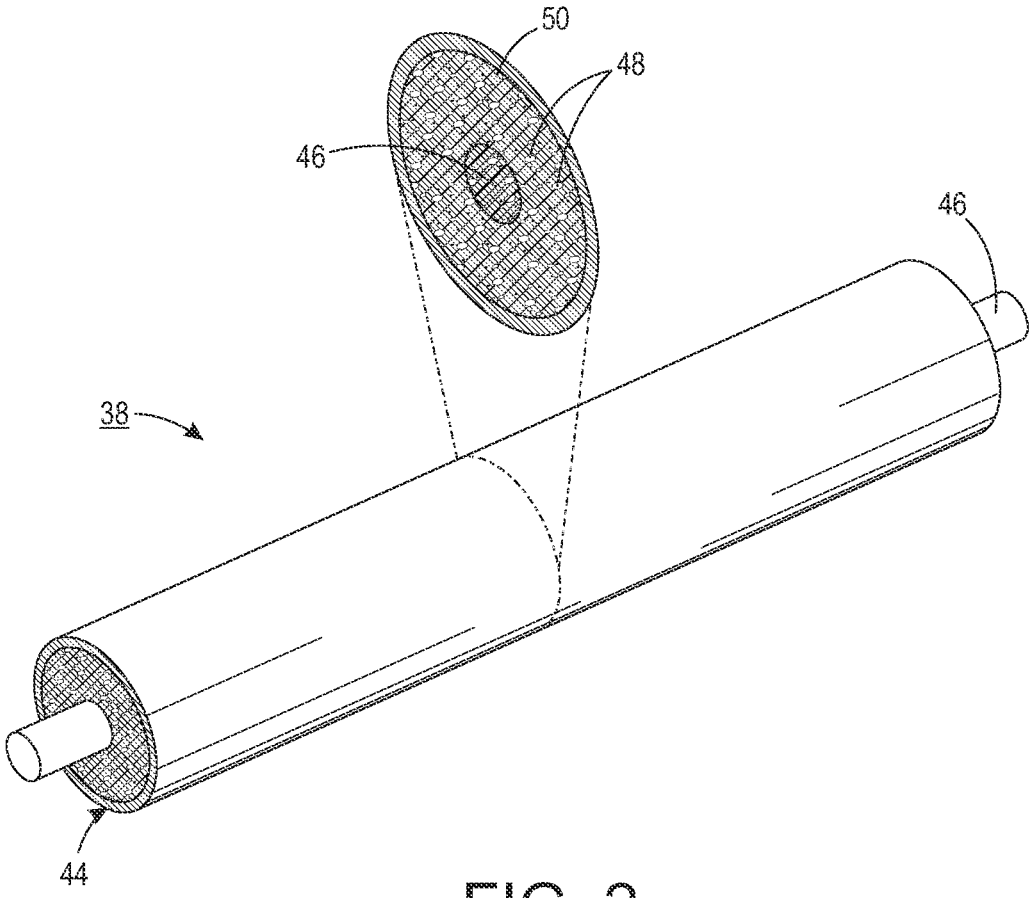
FIG. 2 PRIOR ART
FIG. 2 illustrates a delivery member 38 according to the prior art and a cross-section thereof.

FIG. 2 illustrates a delivery member 38 according to the prior art and a cross-section thereof. The delivery member 38 comprises an elastomeric matrix 44 disposed around a support member 46. In embodiments, the support member 46 is a stainless steel rod. The support member can further comprises a material selected from the group consisting of a metal, plastics, ceramic, and mixtures thereof. The diameter of the support member and the thickness of the elastomeric matrix can be varied depending on the application needs. In specific embodiments, the support member has a diameter of, for example, from about 3 mm to about 10 mm. In specific embodiments, the elastomeric matrix has a thickness of, for example, from 20 um to about 20 mm. In embodiments, the elastomeric matrix 44 may comprises hydrophobic functional materials 48 retained within a polymer matrix 50 such as a cross-linked silicone which forms a matrix that facilitates retainment of the functional materials.

In some embodiments, the functional material is integrated into the composition of the delivery member 38 and thus eliminates the need for a separate supply of materials within the system or the need to constantly reapply the materials to the delivery member. Thus, the delivery member 38 serves the dual purpose of a reservoir and distributor of the functional material. In addition, the delivery members fabricated according to the present embodiments have shown to contain sufficient quantities of the functional material to continuously supply an ultra thin layer of the functional material to the surface of the BCR 36/photoreceptor 34.

Figure 3:
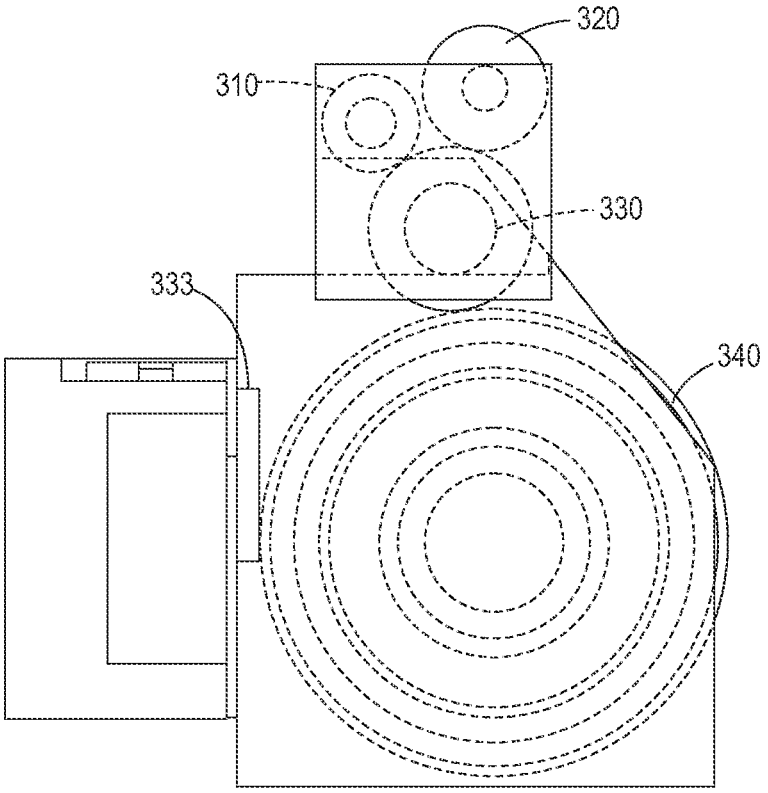
FIG. 3 illustrates a cross-sectional view of a dual roller system that integrates a delivery roller and a cleaning foam roller according to an embodiment of the invention.

FIG. 3 illustrates a cross-sectional view of a dual roller system that integrates a delivery unit and a cleaning unit according to an embodiment of the invention. In embodiments of the invention, the delivery unit is a delivery roller, the cleaning unit is a cleaning foam roller, and the charging unit is a bias charge roller. While this description refers to particular embodiments, it will be understood that many modifications may be made without departing from the spirit thereof. The system includes a delivery unit 310, a cleaning unit 320, a charging unit 330, and a photoreceptor 340. In embodiments of the invention, the dual roll system 300 may be a customer replaceable unit for convenience of the system owner. In embodiments of the invention, the dual roller system may include a second cleaning unit 333. The second cleaning unit may be a cleaning blade.

The delivery unit 310 may be a delivery roller. The delivery roller may be comprised of an elastomeric metrical containing one or more functional materials dispersed therein. In embodiments of the invention, the elastomeric matrix comprises a material selected from a group consisting of polysilxane, polyurethane, polyester, polyfluorosilioxanes, polyolefin, fluoroesastomer, synthetic rubber, natural rubber, and mixtures thereof.

The functional material may be selected from a group consisting of alkanes, fluoroalkanes, alkyl silanes, fluoroalkyl silanes alkoxy-silanes, siloxanes, glycols or polyglycols, mineral oil, synthetic oil, natural oil, and mixtures therethane, polyethylene, polyamide, poypropylenen, rubber materials and mixtures thereof.

In an embodiment of the invention, the cleaning unit comprises a foaming layer. The foaming layer may be comprised of a material selected from polyurethane, polyethylene, polyamide, poypropylenen, rubber materials and mixtures thereof.

The delivery unit 310 contacts the charging unit 330 to deliver an ultra thin layer of the functional material onto the surface of the charging unit 330. The charging unit 330, in turn, transfers the functional material onto a surface of the photoreceptor 340. The clearing unit 320 removes contamination particles from the charging unit 330 before the contamination particles are transferred back to the delivery unit 310. The cleaning unit 320 also reduces toner/additive contamination from entering the delivery roll zone and extends the lifetime of the delivery unit 310. The cleaning unit 320 may also absorb excess functional material (e.g., paraffin oil). The cleaning unit 320 may also eliminate a contact line that appears on the delivery unit 310 after the delivery roll sits for a long period of time in static contact with the charging unit 330. The dual roll system may be integrated into a xerographic printing system in various configurations and positions.

Illustratively, as the charging unit 330 rotates, the delivery unit 310 impregnated with the functional material delivers the functional materials to the surface of the charging unit 330, which in turn, delivers the functional materials to the surface of the overcoated photoreceptor 340 through contact diffusion. The amount of the functional material delivered onto the surface of the imaging member is controlled by the diffusion rate of the functional material in the elastic material of the delivery member.

Figure 4:
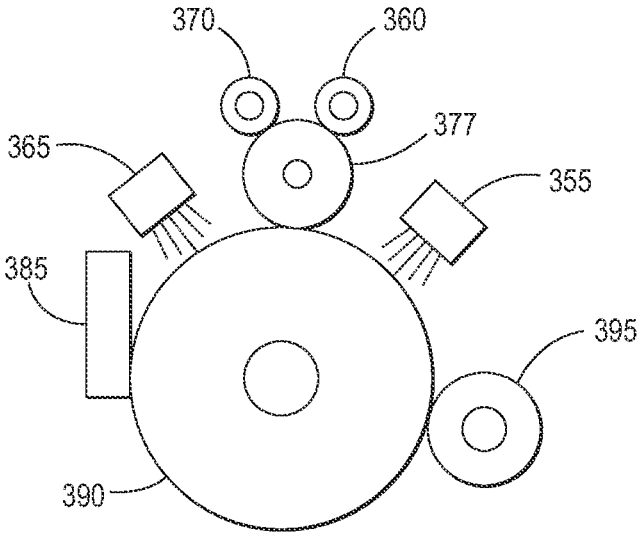
FIG. 4 illustrates a cross-sectional view of an image forming apparatus including a dual roller system

FIG. 4 illustrates a cross-sectional view of a dual roller system in a printing apparatus according to an embodiment of the invention. The printing apparatus includes a delivery unit 370, an exposure light 355, a first cleaning unit 360, an erase light 365, a charging unit 377, a second cleaning unit 385, a photoreceptor 90, and a developer housing 395. The customer replaceable unit 380 in the dual roll system includes the second cleaning unit 385, the photoreceptor 390 and the charging unit 377.

In embodiments of the invention, the first cleaning unit may be a cleaning foam roller, the delivery unit may be a delivery roller, the second cleaning unit may be a cleaning blade and the charging unit may be a bias charge roller (BCR). While this description refers to particular embodiments, it will be understood that many modifications may be made without departing from the spirit thereof.

The delivery unit 370 contacts the charging unit 377 to deliver an ultra-thin layer of the functional material onto the surface of the charging unit 377. The charging unit 377, in turn, transfers the functional material onto the surface of the photoreceptor 390. The delivery member may be integrated into a xerographic printing system in various configurations and positions. The overcoated photoreceptor drum 390 rotates, the delivery unit 370 impregnated with the functional material delivers the functional materials to the surface of the charging unit 377, which in turn, delivers the functional materials to the surface of the overcoated photoreceptor 390 through contact diffusion. For example, the amount of the functional material delivered onto the surface of the imaging member is controlled by the diffusion rate of the functional material in the elastic material of the delivery unit.

Subsequently, the photoreceptor 390 is substantially uniformly charged by the charging unit 377 to initiate the electrophotographic reproduction process. A clearing unit 360 removes contamination particles from the charging unit 330 before the contamination particles are transferred back to the delivery unit 370. The cleaning unit 360 also reduces toner/additive contamination from entering the delivery unit transport area, (e.g., if the delivery unit is a delivery roller, then preventing contamination from entering the roll zone) and extends the lifetime of the delivery unit 370. The cleaning unit 360 may also absorb excess functional material (e.g., paraffin oil). The cleaning unit 360 may also eliminate a contact line that appears on the delivery unit 370 after the delivery unit sits for a long period of time in static contact with the charging unit 377. The charged photoreceptor 390 is then exposed to a light image to create an electrostatic latent image on the photoreceptive member. The latent image is subsequently developed into a visible image by a toner developer 395. Thereafter, the developed toner image is transferred from the photoreceptive member to a copy sheet or some other image support substrate to which the image can be permanently affixed for producing a reproduction of the original document (not shown). The photoreceptor surface is generally then cleaned with a separate cleaning unit 385 to remove any residual developing material thereform, in preparation for successive imaging cycles. While not necessary, a supplying unit containing the functional materials may be included for supply of the functional material to the delivery member. In embodiments which do not have the supplying unit, the supplying unit may be selected from the group consisting of a reservoir, polymeric matrix, porous foam, membrane and fabrics. Subsequently, the photoreceptor 390 is substantially uniformly charged by the charging unit 377 to initiate the electrophotographic reproduction process. The charted photoreceptor is then exposed to a light image to create an electrostatic latent image on the photoreceptive member (not shown). The latent image is subsequently developed into a visible image by a toner developer (not shown). Thereafter, the developed toner image is transferred from the photoreceptive member to a copy sheet or some other image support substrate to which the image can be permanently affixed for producing a reproduction of the original document (not shown). The photoreceptor surface is generally then cleaned with a cleaner to remove any residual developing material thereform, in preparation for successive imaging cycles. While not necessary, a supplying unit containing the functional materials may be included for supply of the functional material to the delivery member. In embodiments which do not have the supplying unit, the supplying unit may be selected from the group consisting of a reservoir, polymeric matrix, porous foam, membrane and fabrics.

Reduction to Practice

Figure 5:
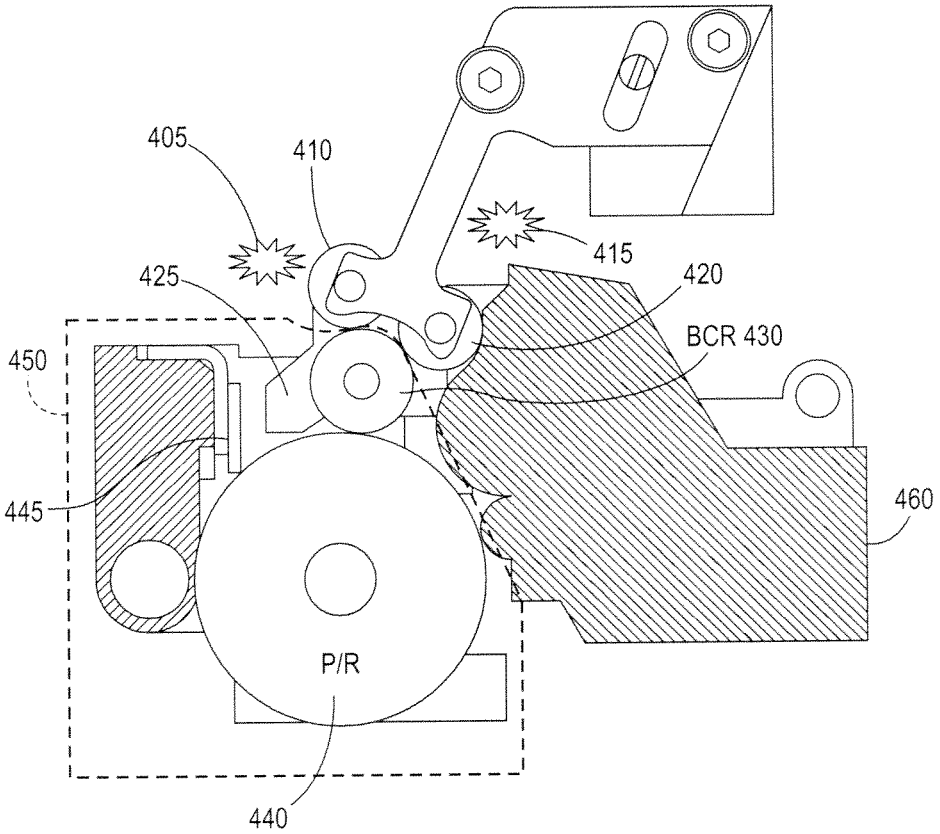
FIG. 5 illustrates a cross-sectional view of a dual roller system prototype and testing apparatus according to an embodiment of the invention.

FIG. 5 illustrates a cross-sectional view of a dual roller system prototype and testing apparatus according to an embodiment of the invention. The dual roller system, as integrated on a text fixture, includes a delivery roller 410, an exposure light 415, a cleaning foam roller 420, an erase light 405, a bias charge roller (BCR) 430, a modified BCR holder 425, a cleaning blade 445, a photoreceptor 440, and a developer housing 460. The customer replaceable unit 450 in the dual roller system integrated in a text fixture includes the cleaning blade 445, the photoreceptor 440, the modified BCR holder 425 and the BCR 430. The text fixture, specifically the delivery roll 410 and cleaning foam roller 420 are modified in that along the axis of the photoreceptor, ⅓rd of the prototype includes only a single cleaning foam roller, whereas ⅔rd of the prototype includes a cleaning foam roller 420 and a delivery roller 410.

In the embodiment illustrated in FIG. 5, the BCR holder 425 was modified to accommodate the dual roll system which was in direct contact with the BCR 430. Three different setups were tested: 1) the delivery roller only; 2) the cleaning foam roller only; and 3) the proposed dual roll system. The text fixture was a paperless test fixture. In the test, the system was run through a total of 50 kilocycles and the amount of contamination in the system was recorded. A lower cost toner (e.g., AHG toner) was utilized in this test because the lower cost toner had severe image deletion and cleaning difficulty when used in a low-wear overcoated photoreceptor. The low-wear overcoated photoreceptor had a wear rate of less than 1 nanometer per 1000 cycles. The BCR was charged to −700 Volts with an alternating voltage of 1.75 kilovolt (which had an alternating current frequency of 1.5 kilohertz). The developer applied a voltage of approximately −530 volts DC. The test environment was approximately 28 degree Centigrade with a humidity of 85%. The cleaning foam roller includes a polyurethane roll and a delivery roll. The toner coverage was approximately 2% through controlling exposure time of the exposure light which was developed on the PR surface every cycle. The photoreceptor rotation speed was approximately 120 revolutions per minute.

Test 1—Delivery Roll Only—In the test run with only a delivery roll, after about 5 kilocycles, the delivery roller showed significant contamination across the entire roll.

Test 2—Cleaning Roller Only. Tests 2 and 3 were run at the same time in the prototype system. On the side of the prototype that only had the cleaning roller, the cleaning roller showed visible contamination at approximately 2000 kilocycles.

Test 3—Cleaning Roller and Delivery Roller (Dual Roll System). At approximately 2000 kilocycles, the side of the prototype with the cleaning foam roller and delivery roll showed no contamination. The experiment was continued for all 50 kilocycles. The delivery roller alone (Test 1) was severely contaminated, the cleaning foam roller alone (Test 2) was severely contaminated, whereas the combination of the delivery roller and the cleaning foam roller in the dual roll system were cleaner in comparison to the case of only the single delivery roller or the single cleaning foam roller.

Figure 6:
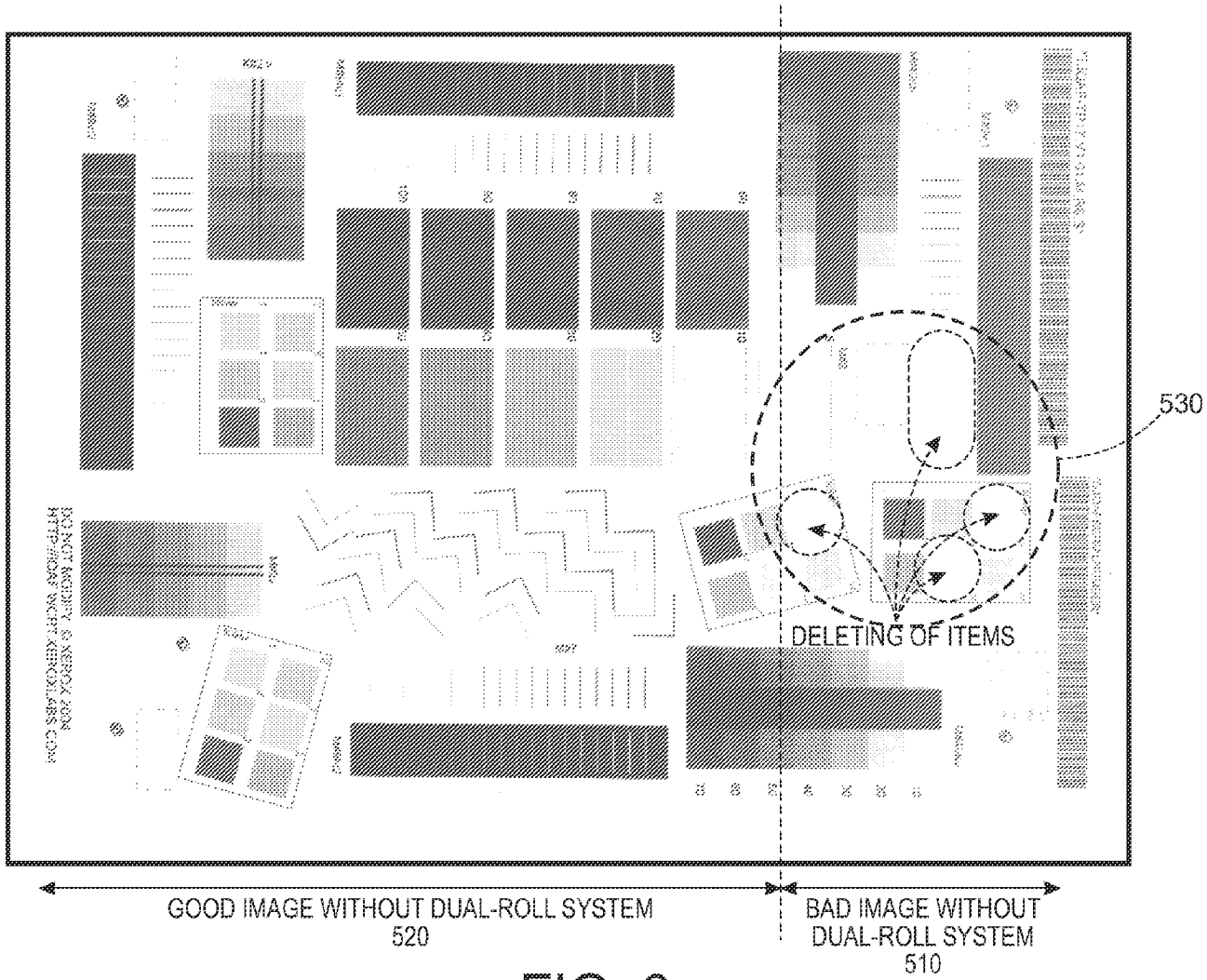
FIG. 6 illustrates a print generated by the toner printing machine which incorporated the prototype and test fixture illustrated in FIG. 4 with the cleaning foam roller only and the proposed novel dual roll system

The test prototype was then placed in a toner machine to generate a print. FIG. 6 illustrates a print generated by the toner printing machine which incorporated the prototype and test fixture illustrated in FIG. 4 with the cleaning foam roller only and the proposed novel dual roll system. The right hand side 510 of the printed image corresponds to the print utilizing the cleaning roll system only. The left hand side 520 of the printed image corresponds to the print utilizing the proposed dual roll system. The right hand side of the print has image deletion and streaking (see area 530 where images are either deleted or washed out). The image deletion and streaking occurs due to the damaged BCR after continuous toner/additive contamination.

Accordingly, the proposed novel dual-roll system (delivery roller and cleaning foam roller) extends the lifetime of both of these rollers. The lifetime is increased when used with a low-wear overcoated photoreceptor that is charged by a BCR. The lifeties of new photoreceptor system incorporating the dual-roll system is greater than 2 million cycles.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. An image forming apparatus comprising:

an electrophotographic photoconductive member;

a charging unit disposed in contact with a surface of the photoconductive member;

a delivery unit disposed in contact with a surface of the charging unit, wherein the delivery unit has functional material dispersed therein and applies a layer of functional material to a surface of the charging unit and the charging unit in turn applies a layer of the functional material onto the surface of the photoconductive member; and a cleaning unit, disposed in contact with a surface of the charging unit to clean the charging unit and reduce contamination of a surface of the delivery unit.

2. The image forming apparatus of claim 1, wherein the cleaning unit is disposed in an upstream direction of the delivery unit relative to a rotation direction of the charging unit and the cleaning unit cleans the charging unit before the charging unit applies the functional material to the surface of the photoconductive member.

3. The image forming apparatus of claim 1, wherein the cleaning unit absorbs excess functional material from the delivery unit.

4. The image forming apparatus of claim 1, wherein the delivery unit comprises an elastomeric matrix containing one or more functional materials as dispersed therein.

5. The image forming apparatus of claim 4, wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

6. The image forming apparatus of claim 1, wherein the functional material is selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

7. An image forming apparatus comprising:

a) an electrophotographic photoconductive member;

b) a charging unit disposed in contact with a surface of the photoconductive member;

c) a delivery unit disposed in contact with a surface of the charging unit, wherein the delivery unit has functional material dispersed therein and applies a layer of functional material to a surface of the charging unit that in turn applies a layer of functional material to the surface of the photoconductive member;

d) a first cleaning unit disposed in contact with the surface of the charging unit to clean the charging unit and reduce contamination of a surface the delivery unit;

e) an electrostatic latent image forming unit that develops an electrostatic latent image on the photoconductive member;

f) a toner developing unit for applying toner to the photoconductive member to develop a toner image on the photoconductive member; and g) a second cleaning unit for cleaning the photoconductive member to remove toner particles.

8. The imaging forming apparatus of claim 7, wherein the first cleaning unit is disposed in an upstream direction of the delivery unit relative to a rotation direction of the charging unit and the first cleaning unit cleans the charging unit before the charging unit applies the functional material to the surface of the photoconductive member.

9. The imaging member apparatus of claim 7, wherein the first cleaning unit absorbs excess functional material from the delivery unit.

10. The image forming apparatus of claim 7, wherein the delivery unit comprises an elastomeric matrix containing one or more functional materials as dispersed therein.

11. The image forming apparatus of claim 10, wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

12. The image forming apparatus of claim 7, wherein the functional material is selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

13. An image forming apparatus comprising:

a charging unit disposed in contact with a surface of the photoconductive member;

a delivery unit disposed in contact with a surface of the charging unit, wherein the delivery unit has functional material dispersed therein and applies a layer of functional material to the surface of the charging unit that in turn applies a layer of functional material to the surface of the photoconductive member; and a cleaning unit disposed in contact with a surface of the charging unit to clean the charging unit and reduce contamination of a surface of the delivery unit.

14. The image forming apparatus of claim 13, wherein the cleaning unit is disposed in an upstream direction of the delivery unit relative to a rotation direction of the charging unit and the cleaning unit cleans the charging unit before the charging unit applies the functional material to the surface of the photoconductive member.

* * * * *